United States Patent [19]

Fulkerson et al.

[11] 4,247,208

[45] Jan. 27, 1981

[54] ELECTRICAL STENOGRAPHIC MACHINE

[76] Inventors: Bennie C. Fulkerson, 810 Franklin Ct.; Michael A. Smith, 3708 Arrowhead Dr., both of Slidell, La. 70458

[21] Appl. No.: 133,080

[22] Filed: Mar. 24, 1980

Related U.S. Application Data

[63] Continuation-in-part of Ser. No. 973,848, Dec. 28, 1978, abandoned.

[51] Int. Cl.[3] ..... B41J 3/26

[52] U.S. Cl. ..... 400/194

[58] Field of Search ..... 400/94, 549, 568, 479–482, 400/91, 477, 399.1; 360/4; 340/365 R, 365 P; 178/21

[56] References Cited

U.S. PATENT DOCUMENTS

| | | | |
|---|---|---|---|
| 972,940 | 10/1910 | Steele | 400/399.1 |
| 1,753,450 | 4/1930 | Thompson | 400/314.6 |
| 1,955,614 | 4/1934 | Thompson et al. | 400/314.3 |
| 2,192,594 | 3/1940 | Brand et al. | 400/94 |
| 2,593,371 | 4/1952 | Watson | 400/94 |
| 2,855,082 | 10/1958 | Katz | 400/94 |
| 3,017,980 | 1/1962 | D'Onofrio | 400/94 X |
| 3,438,477 | 4/1969 | Foersterline | 400/94 X |
| 3,557,927 | 1/1971 | Wright | 400/94 |
| 3,828,911 | 8/1974 | Soderstrom | 400/568 |
| 3,892,915 | 7/1975 | Budworth | 340/365 P |
| 3,964,062 | 6/1976 | Flagg et al. | 340/365 R X |
| 4,181,444 | 1/1980 | Heider | 400/568 |
| 4,195,940 | 4/1980 | Rekewitz | 400/568 |
| 4,205,351 | 5/1980 | Michals | 400/94 X |

*Primary Examiner*—E. H. Eickholt

*Attorney, Agent, or Firm*—Beveridge, DeGrandi, Kline & Lunsford

[57] ABSTRACT

A stenographic machine having electrically powered paper advance and permitting control of key stroke length independent of the paper feed length. The print hammers are mechanically actuated by depression of the associated keys, as in a conventional mechanical stenographic machine. Operation of one or more of the keys actuates an optical switch to trigger a monostable multivibrator, the output of which energizes an actuator to rotate the platen, advancing the paper. The rest position of the keys can be controlled to control the key stroke length, without affecting the paper feed length. The paper advance is initiated on the return stroke of the keys, and so each printed word is visible to the operator immediately after the stroke for that word. In one embodiment the multivibrator energizes a solenoid to rotate the platen, while in a second embodiment the multivibrator energizes an electric motor. If desired, the duration of the multivibrator output pulse can be controlled to control the extent of movement of the solenoid plunger or of the electric motor and thus to control the paper advance length.

24 Claims, 8 Drawing Figures

ELECTRICAL STENOGRAPHIC MACHINE

CROSS-REFERENCE TO RELATED APPLICATIONS

This application is a continuation-in-part of U.S. patent application Ser. No. 973,848, filed Dec. 28, 1978 by Bennie C. Fulkerson and Michael A. Smith, now abandoned the disclosure of which is incorporated herein by reference.

BACKGROUND OF THE INVENTION

The present invention pertains to stenographic machines. More particularly, the present invention pertains to a stenographic machine having electrically powered paper advance and manually actuated print hammers and in which the key stroke length can be controlled independently of the paper advance length.

Present day machine shorthand stenographers generally use manual stenographic machines for several reasons. First of all, in most applications, particularly in court reporting, it is essential that the operation of the machine be as quiet as possible. Heretofore, it has only been manual machines which have been able to operate sufficiently quietly for use in such circumstances. Secondly, stenographers often have to take notes in places where electrical service is non-existent, inconvenient, or unreliable.

Although electrically powered stenographic machines have been available for some time, they have not been widely used for the foregoing reasons, as well as others. Examples of such prior electrically powered stenographic machines are shown in Watson, U.S. Pat. No. 2,593,371, and Katz, U.S. Pat. No. 2,855,082. The machine of the Katz patent utilizes a large number of solenoids and a ratchet drive, all of which contribute to undesirably noisy operation. The Watson machine and also conventional manual machines have another drawback in that the paper advance length is directly related to the key stroke length. Thus, while the length of the paper advance is adjustable, the adjustment control for the paper advance also controls the distance by which the keys must be depressed during each stroke. Consequently in order to achieve a paper advance of sufficient length to space apart the notes taken on the machine by an amount making the notes easily readable, it is necessary to adjust the machine to a point at which the keys must be depressed an inordinate distance. Not only does this slow note taking and more rapidly tire the operator, but also it often results in "shadowing"—the inadvertent striking of an extraneous key, for example the inadvertent striking of a key with the ring finger when keying a note that calls for the middle finger and the little finger. The alternative adjustment, providing a shorter key stroke length, results in a shorter paper advance, making the notes more difficult to read. The action of the keys in advancing the paper has necessitated the interrelationship of these two features. Thus, heretofore, it has not been possible to get a desirably long paper advance without at the same time altering the necessary key depression distance to require an undesirably long key stroke.

In conventional manual stenographic machines, when taking notes at a high rate of speed, or with the machine adjusted to allow short key strokes, there is a danger of "stacking" of notes; i.e., writing characters on top of each other, resulting in unreadable notes. Additionally, conventional manual stenographic machines advance the paper during the downstrokes of the keys, just prior to the printing of a line of notes. A given line of notes thus is not visible to the operator until he writes the next line of notes, unless he stops and manually advances the paper.

SUMMARY OF THE INVENTION

The present invention is a stenographic machine overcoming these numerous shortcomings of conventional stenographic machines. In a stenographic machine in accordance with the present invention, the paper advance is electrically powered, while the print hammers are mechanically actuated. In addition, various characteristics of the machine can be independently adjusted. Thus, the present imvention allows a machine stenographer to adjust the key stroke distance to any length preferred, without affecting the paper advance length. If desired, the paper advance length can be independently adjusted in accordance with the present invention. Consequently, if desired, a shorthand reporter uitlizing a stenographic machine in accordance with the present invention can shorten the key stroke to permit stenographic note taking at a higher speed, and yet, since the paper advance length is not related to the key stroke length, the problem of stacking of notes is avoided. Further, in the stenographic machine of the present invention, the paper advances on the return stroke of the keys immediately after the printing of a line of notes, thereby allowing the operator to see each shorthand word immediately after the stroke for that word. Since the stenographer can select a short key stroke, while still providing a desirably long paper advance, he can take stenographic notes more rapidly and with less effort, while avoiding shadowing.

Because the operation of the keys only serves mechanically to actuate the print hammer, while electrically initiating the paper advance, less effort is required of the operator than in conventional machines in which operation of the keys also serves to mechanically actuate the paper advance. As a consequence of these several factors, the operator can take stenographic notes for longer periods of time with considerably less fatigue. Further, in the stenographic machine of the present invention, upon completion of the downstroke of the keys the initial start of the upstroke propels the stenographer's fingers upward for the next stroke, increasing the stenographer's speed and enhancing his sense of timing.

In the stenographic machine of the present invention, the paper advance clutch arm is inoperative, and the clutch is advanced by an electrically actuated drive mechanism. As the keys are depressed and released, a mechanical linkage actuates an optical switch which applies a current pulse to the drive mechanism to advance the paper. The length of the key stroke is adjustable by adjusting the rest position of the keys, as in conventional manual stenographic machines.

The electrical circuitry utilized to power the paper advance is preferably implemented of components having low current requirements, for example CMOS integrated circuits, making it practical to power the stenographic machine by means of a rechargeable battery. In accordance with preferred embodiments of the present invention, the platen might be rotated by a solenoid or by an electric motor. The paper advance length can be controlled by controlling the duration of the current pulse applied to the solenoid or to the motor which in turn controls the extent of movement of the solenoid plunger or the motor rotor.

The optical switch which is actuated upon actuation of the keys in order to initiate the paper advance is totally silent, and the actuator for the platen is provided with silencing padding to assure quite operation. In the solenoid equipped embodiment, the solenoid is positioned to provide maximum mechanical advantage, permitting use of a smaller, and thus quieter, solenoid. Additionally, the mass of the paper feed components is reduced, permitting use of a smaller, quieter actuator. These several factors minimize the noise of the machine during operation.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals. In the drawings:

DESCRIPTION OF PREFERRED EMBODIMENTS

Figure 1:
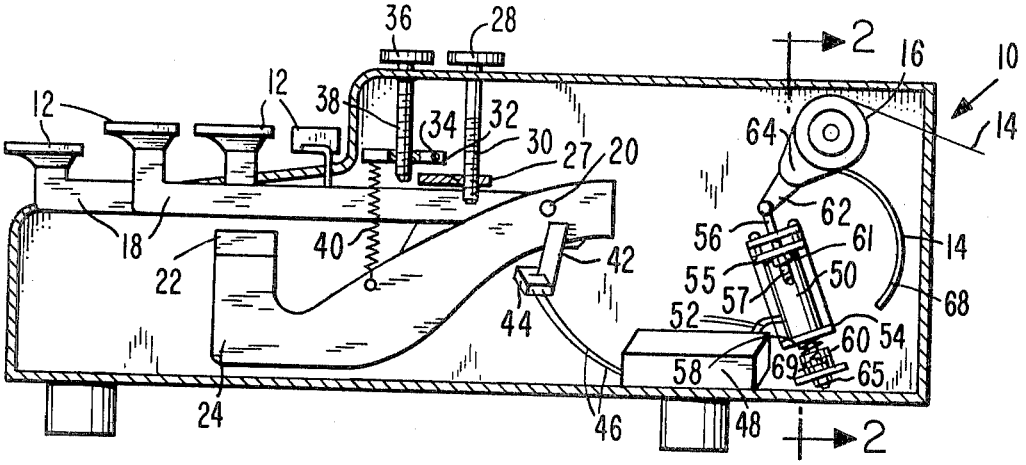
FIG. 1 is a cross-sectional view, taken along line 1—1 of FIG. 2, depicting a stenographic machine in accordance with the present invention.
Figure 2:
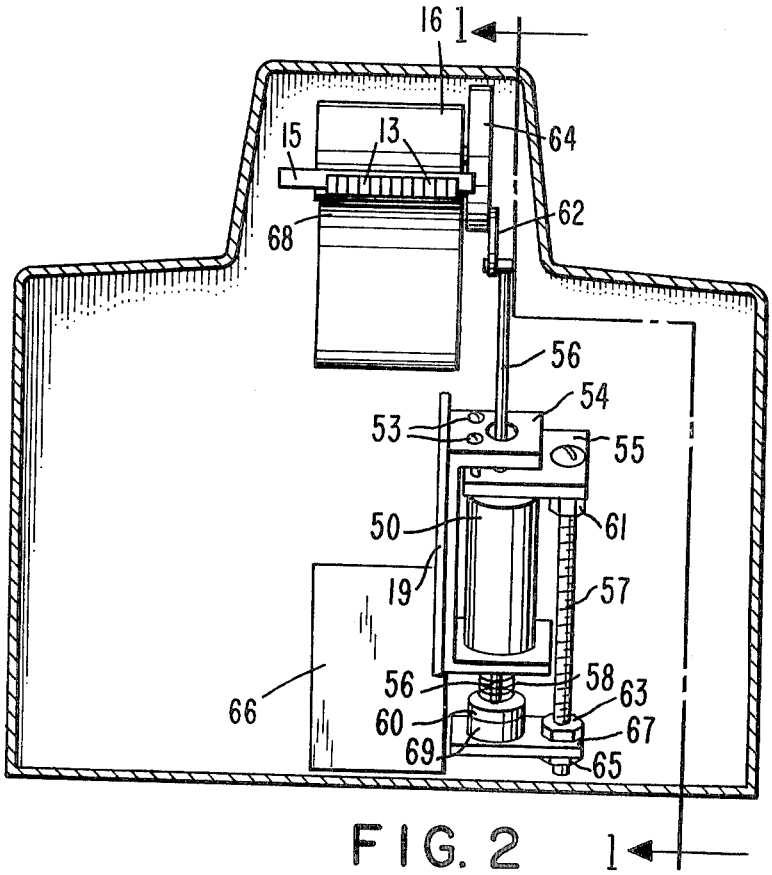
FIG. 2 is a cross-sectional view taken along line 2—2 of FIG.1.

FIGS. 1 and 2 depict stenographic machine 10 in accordance with a first embodiment of the present invention. Many of the components of stenographic machine 10 are the same as found in conventional manual stenographic machines and so are not described in detail. A number of keys 12 (FIG. 1) are provided for mechanical actuation of associated print hammers 13 (FIG. 2), to cause the print hammer 13 to impact on an inked ribbon 15 to print characters on paper 14 as the paper passes over platen 16. Each key 12 is connected to an associated keystem 18. The keystems 18 are pivotally mounted, with respect to the frame 19 of machine 10, at pivot point 20. Keystem rest bar 22 extends across the width of stenographic machine 10 beneath each keystem. Bar 22 is supported on two pivot arms 24, only one of which is visible in FIG. 1, with one arm 24 extending along each side of machine 10 so that if viewed from the top the two pivot arms 24 and keystem rest bar 23 are in the general outline of a U. Each arm 24 is pivotally mounted on frame 19 of machine 10 at pivot point 20. Consequently, when one or more of the keys 12 are depressed, keystem rest bar 22 is depressed, pivoting the arms 24 about pivot point 20.

The upward movement of keys 12 as they return to their home position is limited by stop bar 27, similar to a manual stenographic machine. Control knob 28 is positioned above the upper surface of stenographic machine 10 and is connected to threaded shaft 30 which engages stop bar 27 to permit vertical adjustment of the position of stop bar 27 and thus vertical adjustment of the home position of keys 12. Accordingly, the length of keystroke is controllable by means of control knob 28.

One end of support bar 32 is pivotally attached to the frame 19 of stenographic machine 10 at pivot point 34. Control knob 36 is positioned just above the upper surface of machine 10 and is attached to threaded shaft 38 which engages a threaded opening in support bar 32 between the two ends thereof. Rotation of control knob 36 permits adjustment of the rest position of the second end of support bar 32, relative to the rest position of pivot arm 24. Spring 40 couples the second end of support bar 32 to a point on pivot arm 24 between pivot point 20 and keystem rest bar 22. Thus, each time a key 12 is depressed to depress keystem rest bar 22, spring 40 is elongated. Consequently, control knob 36, in cooperation with the adjustment of control knob 28 and thus of stop bar 27, controls adjustment of the elongation of spring 40 both in the rest position of keystem rest bar 22 and in the depressed position of keystem rest bar 22. Elongation of speirg 40 can be varied by means of control knob 36 raising or lowering the reset position of support bar 32 relative to pivot arm 24. Thus, independently of the key stroke length, the touch of the keys can be adjusted by means of control 36 to suit the operator's preference.

A leaf member 42 extends from one of the pivot arms 24. In the rest position of pivot arm 24, leaf member 42 interrupts the light path of an optical switch 44. When one or more of the keys 12 is depressed to pivot arm 24, leaf member 42 is pivoted out of the light path of optical switch 44. Optical switch 44 is connected by electrical leads 46 to a circuit within electrical assembly 48. Similarly, an actuator, such as a solenoid 50, is connected by electrical leads 52 to electrical assembly 48.

Solenoid 50 is held between first plate member 55 and the lower arm of bracket member 54. Bolts 53 threadedly pass through threaded openings in the upper arm of bracket member 54, and the ends of bolts 53 act against first plate member 55 to retain first plate member 55 tightly against the first end of solenoid 50, the second end of which contacts the lower arm of bracket member 54.

Bolt 57 passes through plate member 55. Nut 61 is fully threaded onto bolt 57, against plate member 55. Nuts 63 and 65 hold second plate member 67 in a fixed position relative to first plate member 55. Padded member 69 is mounted on second plate member 67. Padded stop member 60 is mounted on the end of plunger 56 of solenoid 50, adjacent second plate member 67. Plunger 56 is biased downwardly by spring 58 which is positioned between the lower arm of bracket member 54 and stop member 60. In the quiescent condition of the solenoid, stop member 60 rests on padded member 69. Thus, the position of second plate member 67, as determined by the adjustment of nuts 63 and 65, determines the quiescent position of plunger 56. When electrical assembly 48 energizes solenoid 50, plunger 56 extends upwardly against the bias of spring 58. Thus the position of second plate member 67, by determining the quiescent position of plunger 56, also determines the length of the movement of the plunger upon actuation of solenoid 50, thereby determining the paper feed length.

The outer end of plunger 56 is coupled by link member 62 to clutch member 64 of platen 16. Accordingly, as plunger 56 extends upon actuation of solenoid 50, clutch member 64 pivots to rotate platen 16, advancing the paper 14. As plunger 56 returns within solenoid 50, clutch member 64 pivots back, but without rotation of platen 16.

The stenographic note paper 14 is positioned within storage box 66, shown in FIG. 2, and is threaded about paper guide 68, shown in FIGS. 1 and 2, in conventional manner.

Figure 3:
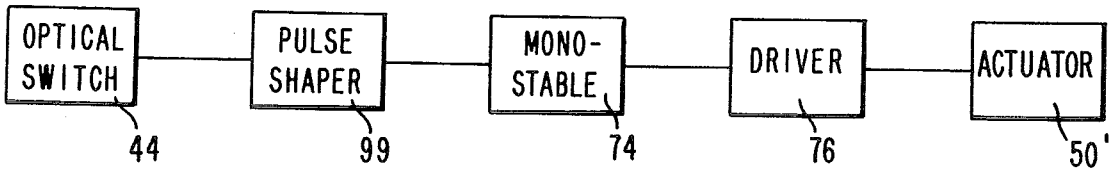
FIG. 3 is a block diagram of an electrical circuit suitable for incorporation into a stenographic machine in accordance with the present invention.

FIG. 3 is a block diagram of the circuitry within electrical assembly 48. The output of optical switch 44 is applied through a pulse shaper 99 to monostable multivibrator 74. The multivibrator output is applied to driver 76, the output of which energizes actuator 50'.

Figure 4:
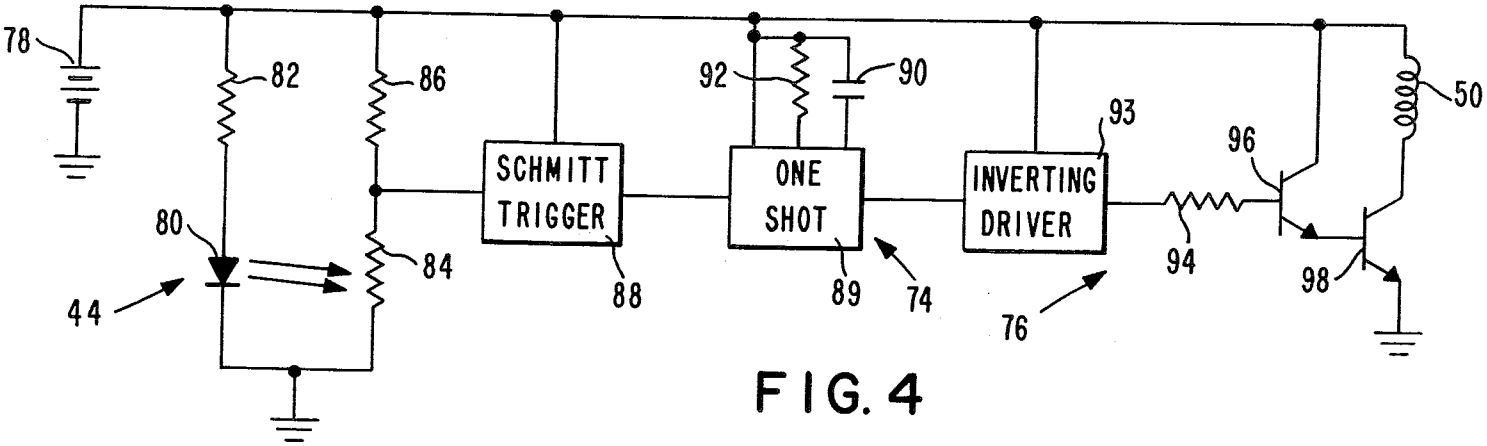
FIG. 4 is a schematic diagram of one preferred embodiment of the circuitry of FIG. 3.

FIG. 4 is a schematic diagram of one preferred embodiment of circuitry for implementing the block diagram of FIG. 3. The negative terminal of battery 78 is tied to ground. Optical switch 44 is made up of light-emitting diode 80, which has its anode coupled to the positive terminal of battery 78 by resistor 82 and its cathode tied to ground, and photoresistor 84, one side of which is coupled to the positive terminal of battery 78 by resistor 86 and the other side of which is tied to ground. The junction of photoresistor 84 and resistor 86 is coupled through Schmitt trigger 88 to the input of one shot 89. The combination of capacitor 90 and resistor 92 control the duration of the output pulse from one shot 89. The output of one shot 89 is applied to inverting driver 93, the output of which is coupled by resistor 94 to the base of NPN transistor 96. Transistor 96 has its collector tied to the positive terminal of battery 78 and its emitter tied to the base of NPN transistor 98. Transistor 98 has its emitter tied to ground and its collector coupled to the positive terminal of battery 78 by the coil of solenoid 50.

The length of the feed of paper 14 with each stroke of keys 12 is dependent upon the displacement of plunger 56 which, in turn, is dependent at least in part on the length of time solenoid 50 is energized. This is dependent upon the duration of the current pulse applied to solenoid 50 by electrical assembly 48 which is dependent on the values of capacitor 90 and resistor 92. The maximum displacement of plunger 56 is limited by the position of second plate member 67 which controls the quiescent position of padded stop member 60 and thus of plunger 56 (FIG. 2).

Leaf member 42, depicted in FIG. 1, is positioned between light-emitting diode 80 and photoresistor 84 so that, in the quiescent condition, light from diode 80 does not reach resistor 84. In this quiescent condition, one shot 89 is at rest, and transistors 96 and 98 are cut off. Accordingly, solenoid 50 is not energized. When one or more of the keys 12 is depressed to pivot arm 24, leaf member 42 is withdrawn from its position between light-emitting diode 80 and photoresistor 84. Light from diode 80 then reaches photoresistor 84 changing its resistance and thus changing the voltage at the input to Schmitt trigger 88 which applies a pulse to one-shot 89. When the keys are released and pivot arm 24 returns to its rest position, leaf member 42 again interrupts the light path between diode 80 and resistor 84. Consequently, the voltage applied to Schmitt trigger 88 returns to its quiescent level, terminating the pulse applied to one-shot 89. As a consequence, one-shot 89 is triggered. The resulting output pulse from one-shot 89 acts through driver 93 to turn on transistors 96 and 98. As a result, solenoid 50 is energized. When one-shot 89 returns to its rest state, transistors 96 and 98 cut off, deenergizing solenoid 50. The length of time that solenoid 50 is energized, and thus the distance which its plunger 56 moves, is dependent upon the duration of the output pulse of one-shot 89. This, in turn, is dependent upon the values of capacitor 90 and resistor 92. Accordingly, the length of advance of paper 14 is independent of the control of the key stroke length.

The following table lists components usable in implementing the circuitry of FIG. 4.

| Part | Identification |
|---|---|
| Battery 78 | 6 volt, 2.4 amp hour, nickel cadmium or sealed lead-acid, rechargeable |
| Optical Switch 44 | Clairex CLI 200 |
| Resistor 82 | 4700 ohm, one-fourth watt |
| Resistor 86 | 470,000 ohm, one-fourth watt |
| Schmitt trigger 88 | one section of a National Semiconductor Corp. 74C 14 hex Schmitt trigger |
| One Shot 89 | National Semiconductor Corp. 74C 221 |
| Capacitor 90 | 0.1 microfarad, 35 volt |
| Resistor 92 | 270,000 ohm |
| Inverting Driver 93 | two or more paralleled sections of a National Semiconductor 74C 14 hex Schmitt trigger |
| Resistor 94 | 10,000 ohm, one-fourth watt |
| Transistor 96 | Sylvania ECG 123A |
| Solenoid 50 | Electro Mechanisms, Inc. Model SP-37 or Model SP-50, |
| Transistor 98 | National Semiconductor 2N6290 |

Other suitable components could, of course, be substituted for those listed above. The Electro Mechanisms SP-37 or SP-50 solenoid is modified slightly to provide more quiet operation and to increase its pulling power. The top pin-guide is removed from the solenoid to allow the plunger to penetrate further into the solenoid body, thus increasing the magnetic surface area and resulting in increased pulling for a given input current pulse.

Figure 5:
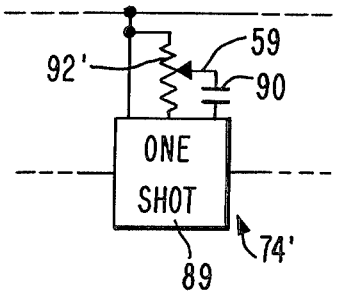
FIG. 5 is a fragmentary schematic diagram depicting an alternative embodiment of circuitry suitable for incorporation into a stenographic machine in accordance with the present invention.

If it is desired to be able to adjust the paper feed length independently of the key stroke distance, fixed monostable multivibrator 74 of FIGS. 3 and 4 is replaced by a variable monostable multivibrator 74', as depicted in FIG. 5. Thus, fixed resistor 92 is replaced by variable resistor 92', of, for example, 500,000 ohms, and capacitor 90 has its first plate tied to the moving contact 59 of the variable resistor. Movable contact 59 thus forms a control for determining the duration of the output pulse from one-shot 89. Control 59 is accessible on the outside of electrical assembly 48. Since the length of paper feed is dependent upon the displacement of plunger 56 of solenoid 50, and since the plunger displacement is dependent, at least in part, on the length of time solenoid 50 is energized, adjustment of control 59 permits control of the paper feed length by adjusting the duration of the current pulse applied to energize solenoid 50, and this paper feed length control is independent of the key stroke distance.

Figure 6:
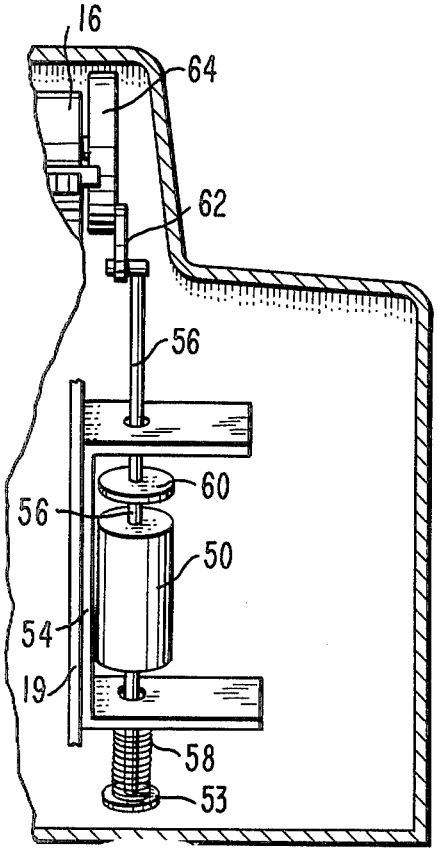
FIGS. 6 and 7 are fragmentary cross-sectional views similar to FIG. 2 and depicting modified embodiments of a stenographic machine in accordance with the present invention.

FIG. 6 depicts an alternative arrangement for mounting solenoid 50. C-shaped bracket member 54' is mounted on frame member 19 of the stenographic machine. Plunger 56 of solenoid 50 is biased downwardly by spring 58 which is positioned between the lower arm of bracket member 54' and head 53 on the lower end of plunger 56. When electrical assembly 48 energizes solenoid 50, plunger 56 extends upwardly against the bias of spring 58. The maximum displacement of plunger 56 is limited by padded stop member 160 which is mounted on plunger 56 to cooperate with the upper arm of bracket member 54 to limit movement of plunger 56 and to assure quiet operation. Either the fixed duration electrical assembly of FIGS. 3 and 4 or the variable duration electrical assembly of FIG. 5 can be used with the solenoid mounting of FIG. 6.

Figure 7:
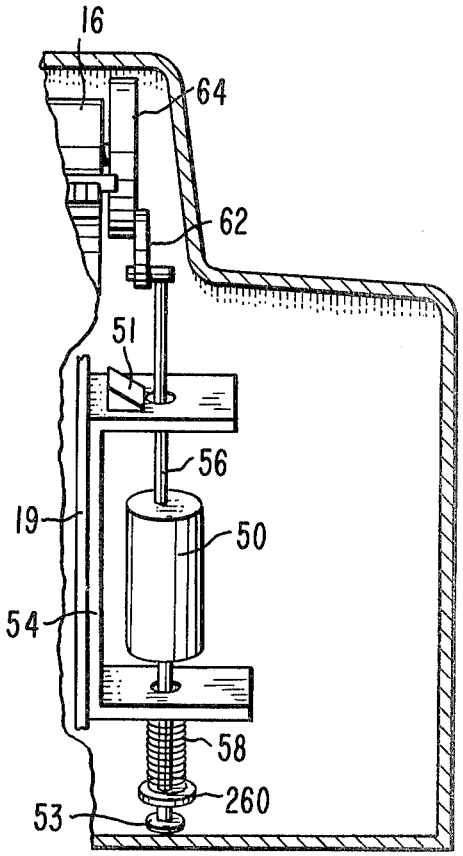

FIG. 7 depicts another solenoid mounting arrangement. Bracket member 54 secures solenoid 50 to the frame 19 of the stenographic machine, and padded stop member 260 is positioned on the side of solenoid 50 opposite link member 62, between the remote end of spring 58 and head 53 on the extreme terminus of plunger 56. A wedge shaped stop pad 51 is positioned beneath link member 62 and the upper surface of the upper arm of bracket member 54 so that, when plunger 56 is retracted within solenoid 50, in the quiescent condition of the solenoid, link member 62 rests on wedge shaped stop pad 51. Pad 51 thus can be positioned as desired on bracket member 54 to limit the solenoid retraction, and thus the paper feed length, to the desired amount, while also reducing noise.

Figure 8:
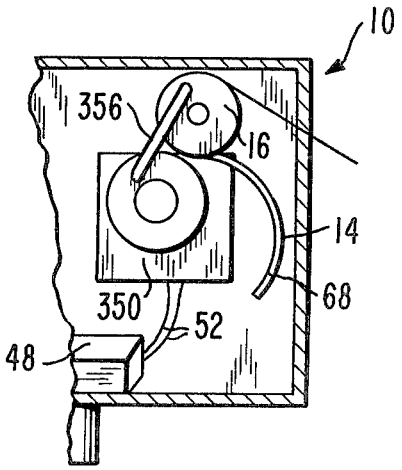
FIG. 8 is a fragmentary cross-sectional view, similar to FIG. 1 and depicting another modified embodiment of a stenographic machine in accordance with the present invention.

In place of a solenoid, platen 16 can be driven by an electric motor. Thus, as depicted in FIG. 8, electrical assembly 48 can be coupled by leads 52 to motor 350 which is mechanically coupled to platen 16 to incrementally rotate the platen each time the motor is energized by a pulse from electrical assembly 48. The electrical circuitry for the motor embodiment of FIG. 7 is as shown in FIG. 3. It differs from FIG. 4 in that motor 350 is positioned in the collector circuit of transistor 98 in place of solenoid 50. Motor 350 might be a conventional d.c. motor or a stepping motor, as desired. If desired, the variable duration monostable multivibrator 74' of FIG. 5 can be used with a conventional d.c. motor, in place of the fixed duration multivibrator 74 of FIGS. 3 and 4.

The use of an optical switch to detect the movement of the keys and to initiate the paper advance is preferred because of the reliablility of such switches and because the optical switch avoids contact bounce problems. Use of CMOS circuitry is preferred since such circuitry has low quiescent current requirements. Accordingly, the current drain on the entire system is so low that battery powered operation is practical. During extended periods of non-use, the battery might maintain its life for up to a month or more without recharging. Even during continuous use, the stenographic machine might be utilized for a full day's work everyday for up to a week without recharging the battery.

Although the present invention has been described with reference to preferred embodiments, rearrangements and modifications might be made within the scope of the invention.

What is claimed is:

1. A stenographic machine comprising a platen adapted for supporting paper; support means adapted for supporting an inked ribbon adjacent said platen; a plurality of print hammers; a plurality of keys mechanically coupled to said print hammers, having a rest position, and operable to mechanically cause said print hammers to impact against an inked ribbon supported by said suport means to bring the inked ribbon into contact with paper supported on said platen; first control means for controlling the rest position of said keys and adjustable to adjust the extent of operation required of said keys to cause said print hammers to impact against the inked ribbon; and electrical actuation means responsive to operation of said keys for rotating said platen to feed paper over said platen with the paper feed length being independent of the rest position of said keys.

2. A stenographic machine as claimed in claim 1 in which said actuation means comprises a solenoid coupled to said platen for rotating said platen to feed paper thereover.

3. A stenographic machine as claimed in claim 1 in which said actuation means comprises an electric motor coupled to said platen for rotating said platen to feed paper thereover.

4. A stenographic machine as claimed in claim 1, 2, or 3 in which said actuation means rotates said platen by a uniform fixed amount, thus providing a fixed paper feed length, upon actuation of said keys.

5. A stenographic machine as claimed in claim 1, 2, or 3 in which said actuation means includes second control means for controlling the amount said platen rotates, and thus the paper feed length, upon operation of said keys.

6. A stenographic machine as claimed in claim 2 in which said actuation means further comprises pulse forming means responsive to operation of said keys for applying a current pulse to said solenoid to actuate said solenoid and rotate said platen.

7. A stenographic machine as claimed in claim 3 in which said actuation means further comprises pulse forming means responsive to operation of said keys for applying a current pulse to said electric motor to actuate said electric motor and rotate said platen.

8. A stenographic machine as claimed in claim 6 or 7 in which said actuation means further comprises second control means for controlling the amount that said platen rotates, and thus the paper feed length, upon operation of said keys.

9. A stenographic machine as claimed in claim 8 in which said second control means controls the duration of the current pulse.

10. A stenographic machine as claimed in claim 6 or 7 in which said pulse forming means is responsive to return of said keys to the rest position upon release thereof during each key operation to cause rotation of said platen, and thus paper feeding, at the end of each key stroke.

11. A stenographic machine comprising a platen adapted for supporting paper; support means adapted for supporting an inked ribbon adjacent said platen; a plurality of print hammers; a plurality of keys mechanically coupled to said print hammers, having a rest position, and operable to mechanically cause said print hammers to impact against an inked ribbon supported on said support means to bring the inked ribbon into contact with paper supported on said platen; contactless switch means responsive to operation of said keys for generating a first actuating signal; electrically operated actuation means coupled to said platen for rotating said platen to feed paper thereover; and coupling means coupled to said contactless switch means and to said actuation means and responsive; to the first actuating signal for applying a second actuating signal to said actuation means to actuate said actuation means and rotate said platen upon operation of said keys.

12. A stenographic machine as claimed in claim 11 in which said actuation means comprises a solenoid.

13. A stenographic machine as claimed in claim 11 in which said actuation means comprises an electric motor.

14. A stenographic machine as claimed in claim 11, 12 or 13 in which said actuation means rotates said platen by a uniform fixed amount, thus providing a fixed paper feed length, upon operation of said keys.

15. A stenographic machine as claimed in claim 11, 12, or 13 in which said actuation means includes control means for controlling the amount said platen rotates, and thus the paper feed length, upon operation of said keys.

16. A stenographic machine as claimed in claim 11, 12, or 13 in which said coupling means comprises pulse forming means responsive to the first actuating signal for applying a current pulse to said actuation means to actuate said actuation means and rotate said platen.

17. A stenographic machine as claimed in claim 16 in which said coupling means further comprises control means for controlling the amount said platen rotates, and thus the paper feed length, upon operation of said keys.

18. A stenographic machine as claimed in claim 17 in which said control means controls the duration of the current pulse.

19. A stenographic machine as claimed in claim 16 in which said coupling means generates the second actuating signal in response to termination of the first actuating signal to cause rotation of said platen, and thus paper feeding, at the end of each key stroke.

20. A stenographic machine as claimed in claim 11 in which said coupling means generates the second actuating signal in response to termination of the first actuating signal to cause rotation of said platen, and thus paper feeding, at the end of each key stroke.

21. A stenographic machine as claimed in claim 11 in which said contactless switch means comprises an optical switch.

22. A stenographic machine as claimed in claim 21 in which said optical switch includes a light source; a light detector; and a leaf member normally assuming a first position and responsive to operation of said keys for movement to a second position, one of said first position and said second position blocking passage of light from said light source to said light detector and the other of said first position and said second position permitting passage of light from said light source to said light detector.

23. A stenographic machine as claimed in claim 22 further comprising a key rest bar and first support means pivotally supporting said key rest bar adjacent said keys for pivoting of said key rest bar and said first support means in response to operation of said keys, said leaf member attached to one of said key rest bar and said first support means for movement therewith.

24. A stenographic machine as claimed in claim 11 further comprising control means for controlling the rest position of said keys to adjust the extent of operation required of said keys to cause said print hammers to impact against said inked ribbon.

* * * * *